US007690948B2

(12) United States Patent
Lung

(10) Patent No.: US 7,690,948 B2
(45) Date of Patent: Apr. 6, 2010

(54) ELECTRICAL CONNECTOR WITH METAL SHELL HAVING CONVEX HULL EXTENDING FROM THE SURFACE OF THE FRONT PORTION THEREOF

(75) Inventor: Ssu-Min Lung, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 34 days.

(21) Appl. No.: 12/069,891

(22) Filed: Feb. 12, 2008

(65) Prior Publication Data

US 2008/0299827 A1 Dec. 4, 2008

(30) Foreign Application Priority Data

Feb. 12, 2007 (TW) ..... 96202652 U

(51) Int. Cl.
*H01R 13/648* (2006.01)

(52) U.S. Cl. ..... 439/607.27; 439/607.55

(58) Field of Classification Search ..... 439/607, 439/610, 607.24, 607.27, 607.47, 607.48, 439/607.53, 607.55
See application file for complete search history.

(56) References Cited

U.S. PATENT DOCUMENTS 6,280,252 B1 * 8/2001 Huang ..... 439/610
6,290,530 B1 * 9/2001 Chang ..... 439/378

* cited by examiner

*Primary Examiner*—Edwin A. Leon
*Assistant Examiner*—Larisa Tsukerman
(74) *Attorney, Agent, or Firm*—Ming Chieh Chang; Wei Te Chung; Andrew C. Cheng

(57) ABSTRACT

An electrical connector includes an insulative housing (1), a plurality of contacts (2) arranged in the insulating housing, a pair of locking pieces (4) received in the insulative housing and a metal shell (3) receiving the insulative housing. The insulative housing has a base portion (11) and a tongue portion (12) extending from the base portion. The metal shell includes a main shell (31) and a sub shell (32) an ached to the main shell. The main shell has a front shroud portion (311) surrounding the tongue portion of the insulative housing and a rear portion (312) supporting the base portion. The front shroud portion forms at least one embossed portion (313) thereon. The sub shell is attached to the rear portion of the main shell and has a curve portion (321) abutting against a rear end of the front shroud portion to enclose the base portion of the insulative housing. The main shell and the sub shell each have curve arms (3102, 3202) abutting against the rear ends of the locking pieces.

3 Claims, 6 Drawing Sheets

ELECTRICAL CONNECTOR WITH METAL SHELL HAVING CONVEX HULL EXTENDING FROM THE SURFACE OF THE FRONT PORTION THEREOF

BACKGROUND OF THE INVENTION

1. Field of the Invention

The present invention generally relates to an electrical connector, and more particularly relates to an electrical connector with a metal shell having at least one embossed portion extending from the front shroud portion thereof.

2. Description of Related Arts

Electrical connection between a system and peripherals is established through a receptacle connector and a plug connector. Generally, the receptacle with recessed space is installed in the system and the plug with protruding front mating portion is extended from a peripheral, such as a cable end.

Chinese Patent CN No. 2886835 Y discloses an electrical connector, i.e. a plug connector. The plug connector typically comprises a separable metal shell, an insulative housing and a plurality of contacts. When the plug connector is connected with the receptacle, the retention force for securing the plug within the receptacle is ensured by the normal force between contacts of receptacle connector and contacts of plug connector. The receptacle and plug connector assembly are often jerked out by accidental force if the retention force is not robust enough.

Hence, an improved electrical connector is required to overcome the aforesaid disadvantages of the prior art.

SUMMARY OF THE INVENTION

It is an object of the present invention to provide an electrical connector with a metal shell, which can supply enough retention force.

In order to achieve the above-mentioned object, an electrical connector includes an insulative housing, a plurality of contacts arranged in the insulating housing, a pair of locking pieces received in the insulative housing and a metal shell receiving the insulative housing. The insulative housing has a base portion and a tongue portion extending from the base portion. The metal shell includes a main shell and a sub shell attached to the main shell. The main shell has a front shroud portion surrounding the tongue portion of the insulative housing and a rear portion supporting the base portion. The front shroud portion forms at least one embossed portion thereon. The sub shell is attached to the rear portion of the main shell and has a curve portion abutting against a rear end of the front shroud portion to enclose the base portion of the insulative housing. The main shell and the sub shell each have curve arms abutting against the rear ends of the locking pieces.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
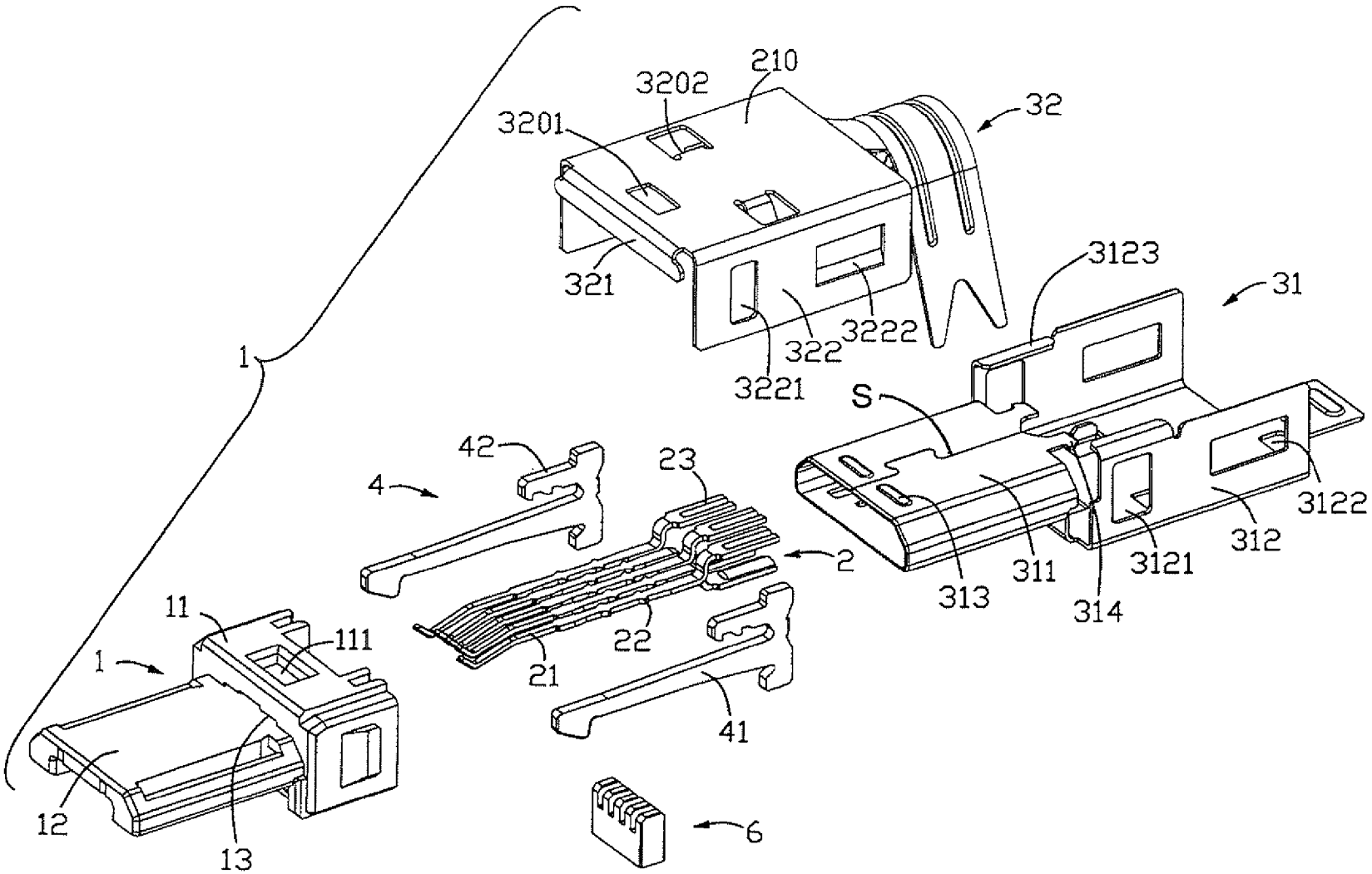
FIG. 1 is a perspective view of an electrical connector in accordance with the present invention.

Reference will now be made to the drawing figures to describe the present invention in detail.

As shown in FIG. 1, an electrical connector 100 in accordance with the present invention typically comprises a separable metal shell 3, an insulative housing 1 and a plurality of contacts 2. A pair of locking pieces 4 and a block 5 are further received in the insulative housing 1.

Figure 2:
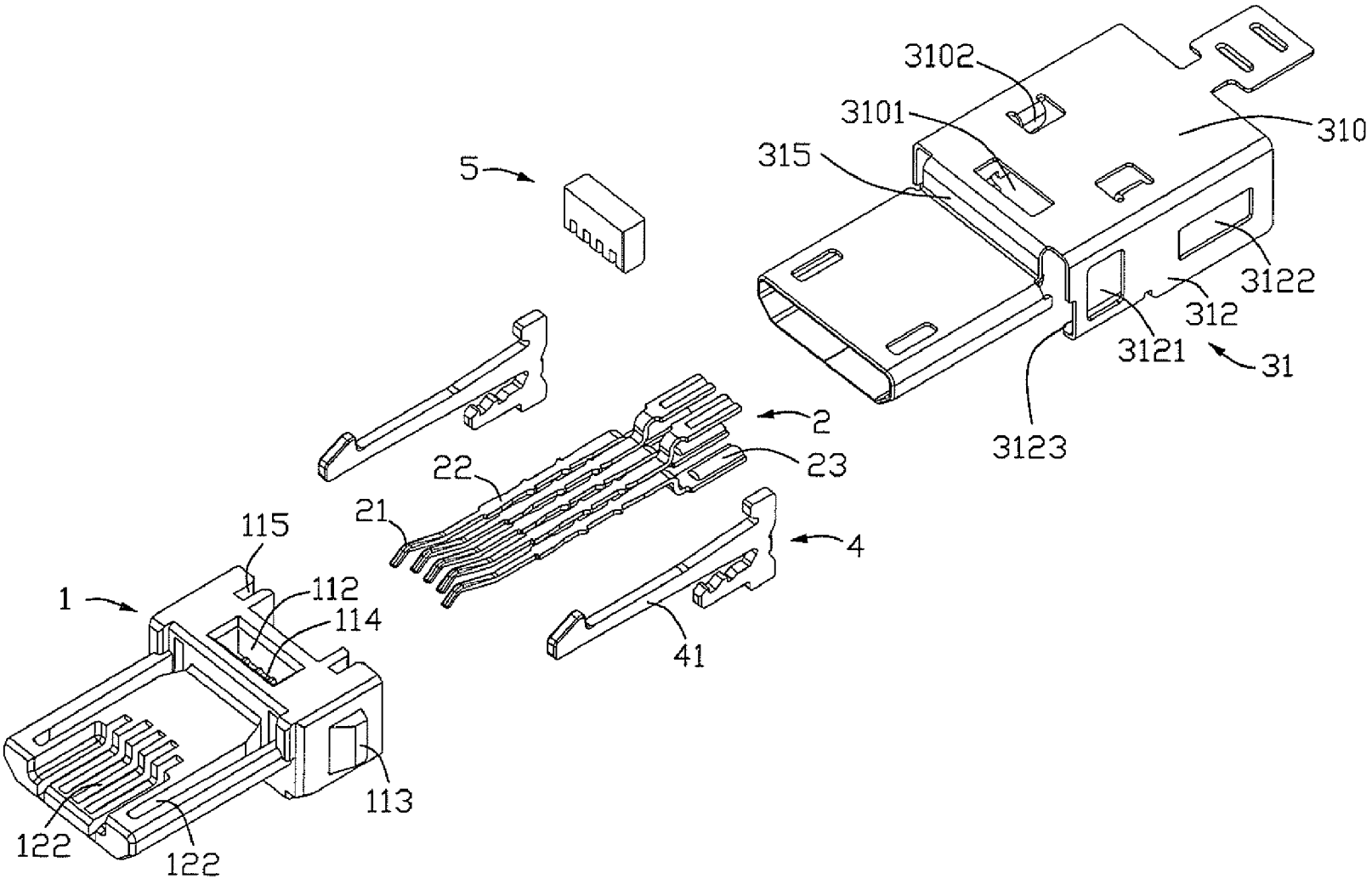
FIG. 2 is an exploded view of the electrical connector shown in FIG. 1.

Referring to FIG. 1 and FIG. 2, the insulative housing 1 includes a base portion 11 and a tongue portion 12 extending therefrom. The base portion 11 defines a first cave 111 in the top surface and a second cave 112 in the bottom surface. A pair of projections 113 extends from the both sides of the base portion 11. There is a plurality of first recesses 114 running through the base portion 11 in the longitudinal direction. A pair of first slots 115 run through the base portion 11 near the first recesses 114. Relating to the first recesses 114 and the first slots 115, there are second recesses 121 and second slots 122 located at the tongue portion 12. The first and second recesses 114,121 receive the contacts 2 in themselves, and the first and second 115,122 receive the locking pieces 4 in themselves. The insulative housing 1 further defines a retention gap 13 in a front portion of the base portion 11 and forwardly communicating with an exterior adjacent to said tongue portion 12.

Referring to FIG. 1 and FIG. 2, the contacts 2 have a touching portion 21, a connecting portion 22 neighbor on the touching portion 21, and a welding portion 23 closely vicinity to the connecting portion 22. The touching portion 21 is connected with the mating connector (not shown), however the welding portion 23 is connected with a cable (not shown) or others.

Figure 3:
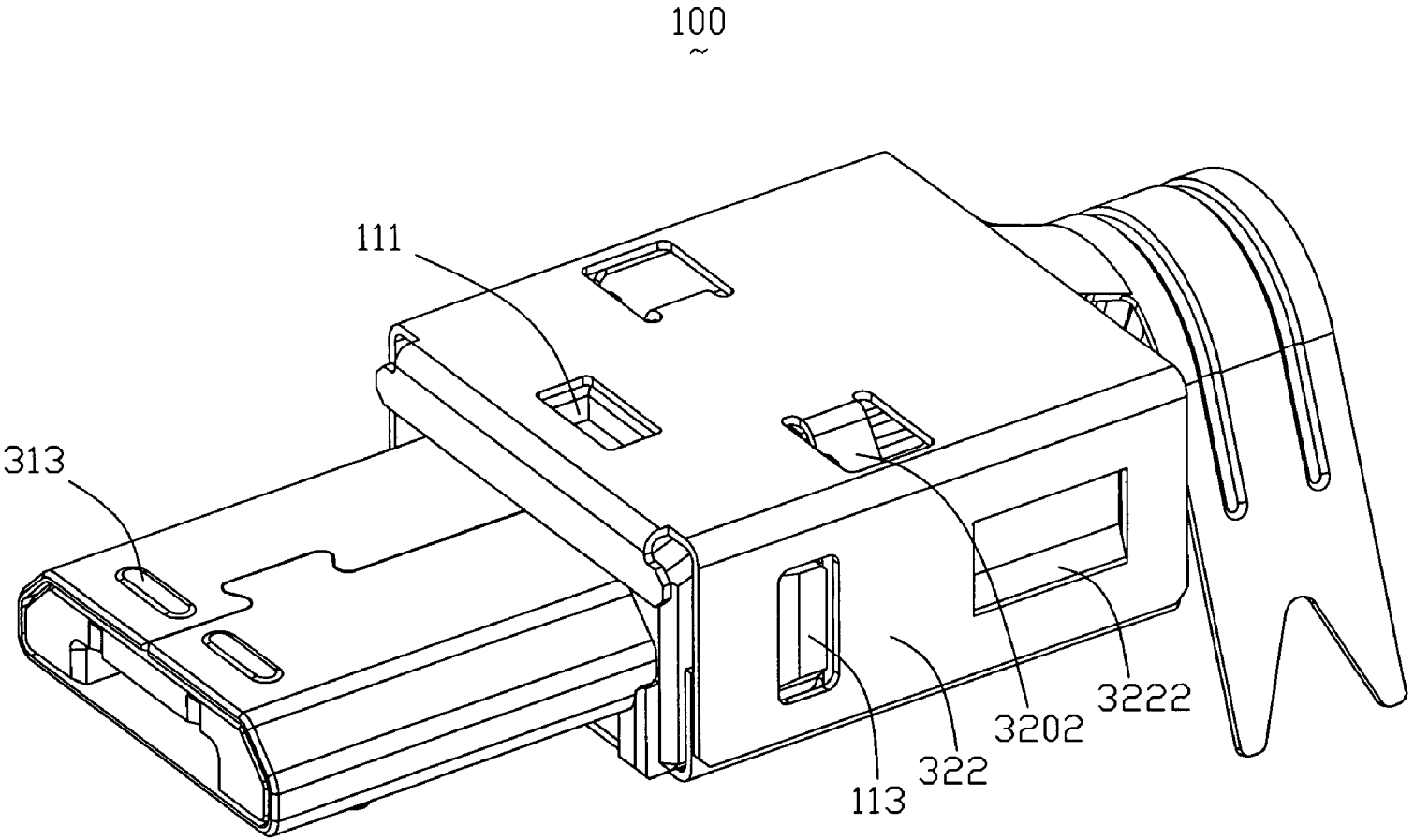
FIG. 3 is a perspective view of the electrical connector in FIG. 1 from another direction, the sub shell is hidden.

Referring to FIG. 1 to FIG. 3, the metal shell 3 receiving the insulative housing 1, comprises a main shell 31 and a sub shell 32 attaching to the main shell 31. The main shell 31 has a front shroud portion 311 surrounding the tongue portion 12 of the insulative housing 1 and a rear portion (not labeled) extending rearward from the front shroud portion 311 for supporting the base portion 11 of the insulative housing 1. The front shroud portion 311 is connected with the rear portion via a neck section 315. The front shroud portion 311 forms at least one embossed portion 313 on surfaces thereof for interfering an inserted mating connector (not shown) and providing a firm connection with the mating connector. The front shroud portion 311 forms a pair of spaced retaining lancing devices 314 having opposite outward hooks and horizontally extending rearwardly from a rear edge thereof, which is received in the retention gap 13 for retaining the main shell 31 to the insulative housing 1. The front shroud portion 311 defines a seam S and said pair of spaced retaining lancing devices 314 are located by two sides of said seam S. The rear portion comprises a pair of opposite walls namely first sidewalls 312 and a bottom wall 310 connecting the first sidewalls 312 together. The first sidewalls 312 define a pair of first and second openings 3121, 3122 and form a pair of fins 3123 bending inwardly. The bottom wall 310 defines a first hole 3101 and forms a pair of bottom curve arms 3102. The sub shell 32 forms a curve portion 321 also called an abutment portion 321 at a front part thereof for abutting against a rear end of the front shroud portion 311 and enclosing the base portion 11, a pair of opposite walls namely second sidewalls 322 and a top wall 320 connecting the second sidewalls 322 together. After assembly, the abutment portion 321 is located adjacent to the retaining lancing devices 314, and the abutment portion 321 and the neck section 315 are respectively located by two sides of the front shroud portion 311. The sidewalls 322 define a pair of third openings 3221 respectively corresponding to the first openings 3121 and form a pair of lugs 3222 bending inwardly. The top wall 320 defines a second hole 3201 and forms a pair of top curve arms 3202. The bottom curve arms 3102 of the main shell 31 and the top curve arms 3202 of the sub shell 32 both abut against rear ends of the locking pieces 4 respectively in lower and upper levels thereof.

Referring to FIG. 1 and FIG. 2, the locking pieces 4 comprise locking portion 41 and holding portion 42, when assembling, the holding portion 42 and the locking portion 41 are respectively received in the first and second slots 115,122 of the insulative housing 1.

Figure 4:
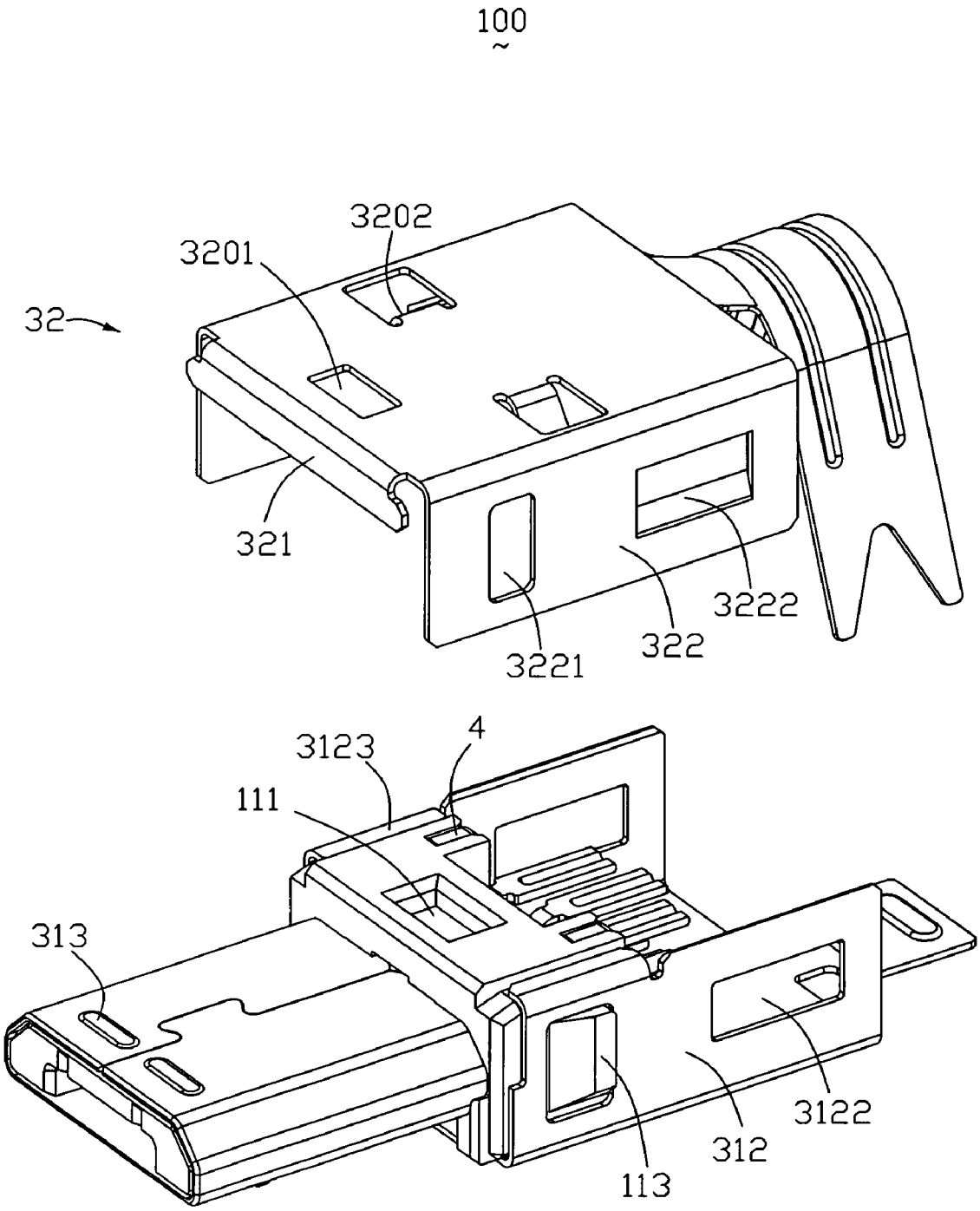
FIG. 4 is an exploded view of the electrical connector showing when the sub shell is covering the assembled main shell.
Figure 5:
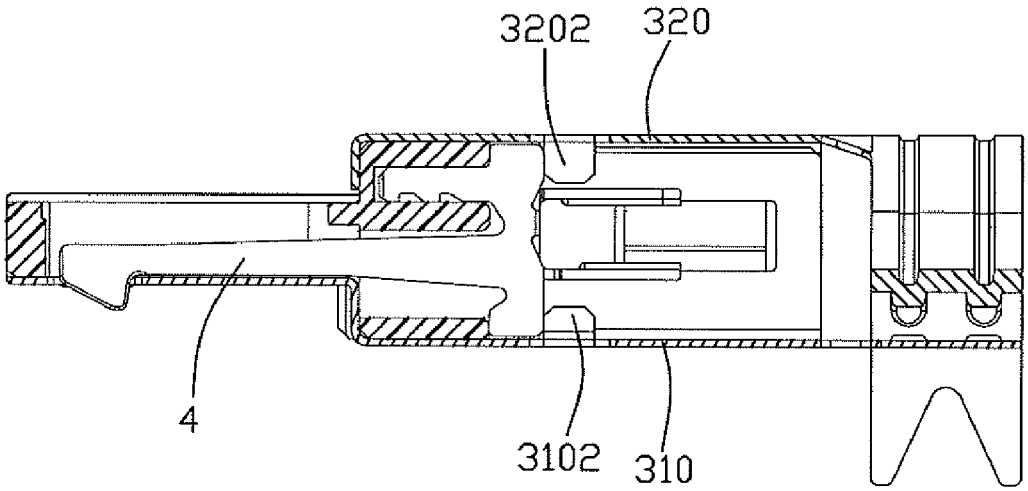
FIG. 5 is a cross-section view of the electrical connector.
Figure 6:
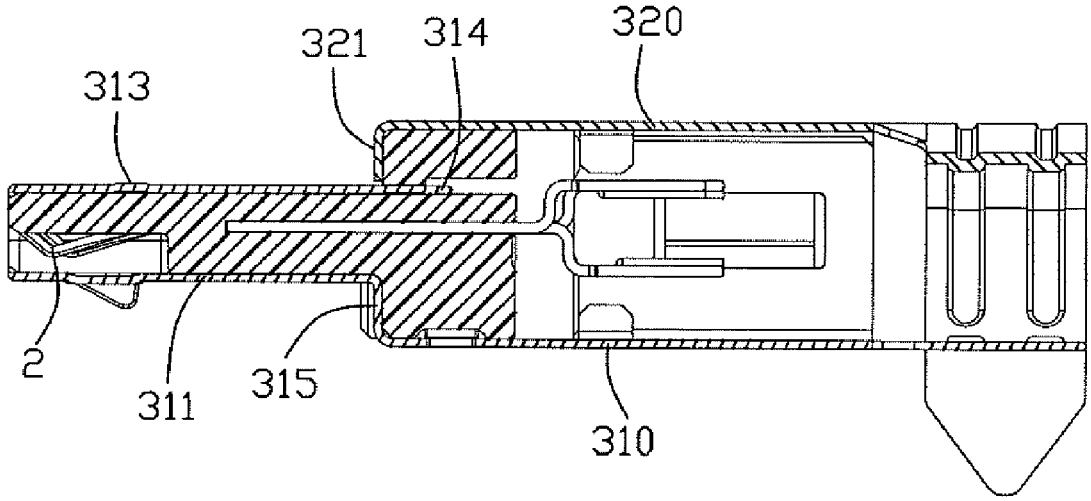
FIG. 6 is another cross-section view of the electrical connector.

Referring to FIG. 4, insert the contacts 2 and the locking pieces 4 into the insulative housing 1 from the rear end, the contacts 2 are received into the first and second recesses 114,121, wherever the locking pieces 4 are received into the first and second slots 115,122. The main shell 31 contains the insulative housing 1 therein, putting the block 5 in the first cave 111 of the insulative housing 1. Cover the sub shell 32 over the main shell 31 in quick succession. The electrical connector 100 is assembly shown as FIG. 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a base portion and a tongue portion extending from the base portion, the base portion having a pair of projections extending from both sides thereof;

a plurality of contacts arranged in the insulative housing;

a pair of locking pieces received in the insulative housing; and a metal shell receiving the insulative housing, comprising a main shell and a sub shell attached to the main shell, the main shell having a front shroud portion surrounding the tongue portion of the insulative housing and a rear portion supporting the base portion, the sub shell attached to the rear portion of the main shell and having a curve portion abutting against a rear end of the front shroud portion to enclose the base portion of the insulative housing, both the main shell and the sub shell defining a pair of openings respectively and correspondingly to receive the projections of the insulative housing; wherein the front shroud portion forms at least one embossed portion; and wherein the main shell and the sub shell each have curve arms abutting against the rear ends of the locking pieces.

2. The electrical connector as described in claim 1, further comprising a block received in the insulative housing and touching the contacts.

3. A metal shell made of a piece of metal sheet and receiving an insulative housing, the insulative housing having a tongue portion and a base portion connecting with the tongue portion, comprising:

a main shell and a sub shell attached to the main shell;

the main shell having a front shroud portion surrounding the tongue portion of the insulative housing, and a rear portion supporting the base portion, the rear portion having a pair first sidewalls that define a pair of first and second openings and a pair of fins extending therefrom and a bottom wall, on which a first hole and a pair of bottom curve arms are mounted, connecting the first sidewalls together;

the sub shell attached to the rear portion of the main shell, having a curve portion abutting against a rear end of the front shroud portion to enclose the base portion of the insulative housing, a pair of second sidewalls that defines a pair of third openings and lugs respectively corresponding to the first openings and a top wall, on which a second hole and a pair of top curve arms mounted, connecting the second sidewalls together; wherein the front shroud portion forms at least one embossed portion.

* * * * *